US009368095B2

(12) United States Patent
Oh et al.

(10) Patent No.: US 9,368,095 B2
(45) Date of Patent: Jun. 14, 2016

(54) METHOD FOR OUTPUTTING SOUND AND APPARATUS FOR THE SAME

(71) Applicant: Samsung Electronics Co., Ltd., Suwon-si, Gyeonggi-do (KR)

(72) Inventors: Hae-Seok Oh, Gumi-si (KR); Jeong-Yeon Kim, Daegu (KR); Dae-Beom Park, Gumi-si (KR); Lae-Hyuk Bang, Gumi-si (KR); Chul-Hyung Yang, Gumi-si (KR); Gyu-Cheol Choi, Gumi-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/553,066

(22) Filed: Nov. 25, 2014

(65) Prior Publication Data

US 2015/0143978 A1 May 28, 2015

(30) Foreign Application Priority Data

Nov. 25, 2013 (KR) ..... 10-2013-0143682

(51) Int. Cl.
*G10H 1/18* (2006.01)
*G10H 3/12* (2006.01)
*G10H 5/00* (2006.01)

(52) U.S. Cl.
CPC ..... *G10H 3/125* (2013.01); *G10H 5/005* (2013.01); *G10H 2210/066* (2013.01); *G10H 2230/275* (2013.01)

(58) Field of Classification Search
IPC ..... G10H 3/125,5/005, 2210/066
See application file for complete search history.

(56) References Cited

U.S. PATENT DOCUMENTS 3,948,139 A * 4/1976 Melcher ..... G10H 1/02 84/700
3,999,456 A * 12/1976 Tsunoo ..... G10H 5/005 84/675
4,342,244 A * 8/1982 Perkins ..... G10H 1/32 84/171
4,463,650 A * 8/1984 Rupert ..... G10H 5/005 84/616
4,757,737 A * 7/1988 Conti ..... G10H 1/32 704/258
5,171,930 A * 12/1992 Teaney ..... A61B 5/04886 381/118
5,428,708 A * 6/1995 Gibson ..... G10G 7/02 704/207
5,499,922 A * 3/1996 Umeda ..... G10H 1/0066 434/307 A
5,521,324 A * 5/1996 Dannenberg ..... G10H 1/0058 84/612
5,619,004 A * 4/1997 Dame ..... G10H 3/125 704/207
5,957,696 A * 9/1999 Kageyama ..... G10H 1/361 360/69
6,124,544 A * 9/2000 Alexander ..... G10H 3/125 84/616
6,372,973 B1 * 4/2002 Schneider ..... G10H 1/20 84/609
6,424,944 B1 * 7/2002 Hikawa ..... G10L 13/08 704/258
6,737,572 B1 * 5/2004 Jameson ..... G10H 3/125 84/741
7,323,629 B2 * 1/2008 Somani ..... G10H 1/0008 700/94

(Continued)

FOREIGN PATENT DOCUMENTS

KR 10-0664677 B1 12/2006
KR 2012-0096880 A 8/2012

*Primary Examiner* — David Warren
(74) *Attorney, Agent, or Firm* — Jefferson IP Law, LLP

(57) ABSTRACT

A method and an apparatus for outputting a sound corresponding to a musical instrument which is input by using a voice are provided. The method includes identifying a sound including an original sound, identifying an output sound object corresponding to an acoustic characteristic of the original sound, and outputting the output sound object, corresponding to musical characteristics of the original sound. Further, various aspects are provided which are related to the method and the apparatus which enable inputting sounds of a musical instrument using a voice.

19 Claims, 9 Drawing Sheets

(56) References Cited

U.S. PATENT DOCUMENTS 8,581,087 B2 * 11/2013 Hashimoto ..... G10H 1/0008 84/615
8,892,565 B2 * 11/2014 Xu ..... G06F 17/30743 704/207
2003/0066414 A1 * 4/2003 Jameson ..... G10H 3/125 84/741
2005/0086052 A1 * 4/2005 Shih ..... G06F 17/30743 704/207
2006/0246407 A1 * 11/2006 Kang ..... G09B 5/04 434/307 A
2007/0137467 A1 * 6/2007 Sim ..... G10H 1/0066 84/645
2008/0223202 A1 * 9/2008 Shi ..... G10H 1/383 84/645
2012/0067196 A1 * 3/2012 Rao ..... G10H 1/363 84/611
2012/0234158 A1 * 9/2012 Chan ..... G10L 13/0335 84/622

* cited by examiner

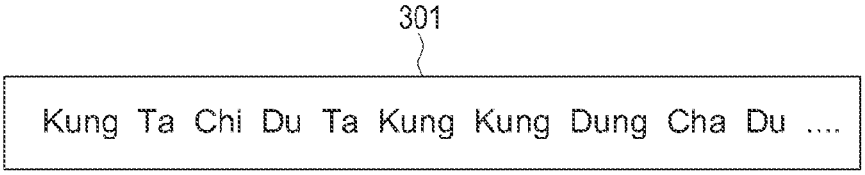
FIG.3A
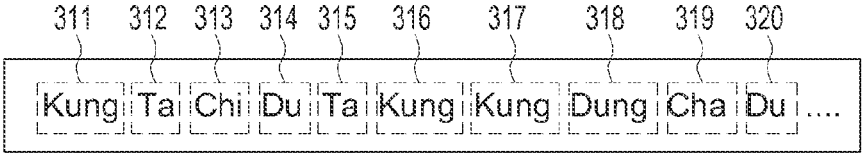
FIG.3B
| VOICE IN UNIT OF SYLLABLE | ACOUSTIC CHARACTERISTIC VALUE |
|---|---|
| "Kung" | ACOUSTIC CHARACTERISTIC VALUE 1 |
| "Ta" | ACOUSTIC CHARACTERISTIC VALUE 2 |
| "Chi" | ACOUSTIC CHARACTERISTIC VALUE 3 |
| "Du" | ACOUSTIC CHARACTERISTIC VALUE 4 |
| "Dung" | ACOUSTIC CHARACTERISTIC VALUE 5 |
| "Cha" | ACOUSTIC CHARACTERISTIC VALUE 6 |
| ⋮ | ⋮ |
FIG.3C

| ACOUSTIC CHARACTERISTIC VALUE | OUTPUT SOUND OBJECT |
|---|---|
| ACOUSTIC CHARACTERISTIC VALUE 1 | "Base drum" |
| ACOUSTIC CHARACTERISTIC VALUE 2 | "Snare drum" |
| ACOUSTIC CHARACTERISTIC VALUE 3 | "Hi-hat cymbals" |
| ACOUSTIC CHARACTERISTIC VALUE 4 | "Mid/High Tom-Tom" |
| ACOUSTIC CHARACTERISTIC VALUE 5 | "Floor Tom-Tom" |
| ACOUSTIC CHARACTERISTIC VALUE 6 | "Ride cymbals" |
| ⋮ | ⋮ |

FIG.4B

| ACOUSTIC CHARACTERISTIC VALUE | OUTPUT SOUND OBJECT |
|---|---|
| ACOUSTIC CHARACTERISTIC VALUE 1 | SOUND OF PUPPY |
| ACOUSTIC CHARACTERISTIC VALUE 2 | SOUND OF CAT |
| ACOUSTIC CHARACTERISTIC VALUE 3 | SOUND OF DUCK |
| ACOUSTIC CHARACTERISTIC VALUE 4 | SOUND OF CHICKEN |
| ACOUSTIC CHARACTERISTIC VALUE 5 | SOUND OF PIG |
| ACOUSTIC CHARACTERISTIC VALUE 6 | SOUND OF CALF |
| ⋮ | ⋮ |

FIG.4D

| VOICE OF USER | ACOUSTIC CHARACTERISTIC VALUE | OUTPUT SOUND OBJECT |
|---|---|---|
| "BOWWOW" | ACOUSTIC CHARACTERISTIC VALUE 1 | SOUND OF PUPPY |
| "MEOW" | ACOUSTIC CHARACTERISTIC VALUE 2 | SOUND OF CAT |
| "QUACK-QUACK" | ACOUSTIC CHARACTERISTIC VALUE 3 | SOUND OF DUCK |
| "COCK-A-DOODLE-DOO" | ACOUSTIC CHARACTERISTIC VALUE 4 | SOUND OF CHICKEN |
| "OINK-OINK" | ACOUSTIC CHARACTERISTIC VALUE 5 | SOUND OF PIG |
| "MOO" | ACOUSTIC CHARACTERISTIC VALUE 6 | SOUND OF CALF |
| ⋮ | ⋮ | ⋮ |

FIG.7

METHOD FOR OUTPUTTING SOUND AND APPARATUS FOR THE SAME

CROSS-REFERENCE TO RELATED APPLICATION(S)

This application claims the benefit under 35 U.S.C. §119 (a) of a Korean patent application filed on Nov. 25, 2013 in the Korean Intellectual Property Office and assigned Serial number 10-2013-0143682, the entire disclosure of which is incorporated herein by reference.

TECHNICAL FIELD

The present disclosure relates to a method and an apparatus, which change an input sound to an instrument sound and output the instrument sound.

BACKGROUND

Recently, various services and additional functions, which are provided by electronic devices (particularly, mobile terminal devices), have been gradually expanded. In order to increase the effective value of electronic devices and meet various needs of users, various applications executable by the electronic device have been developed.

The electronic device may store and execute default applications, which are developed by a manufacturer of the relevant device and installed on the relevant device, additional applications downloaded from application sales websites on the Internet, and the like. The additional applications may be developed by general developers and registered on the application sales websites. Accordingly, anyone who has developed applications may freely sell them to users of the electronic devices on the application sales websites. As a result, at present, tens to hundreds of thousands of free or paid applications are provided to the electronic devices depending on the specifications of the electronic devices.

Meanwhile, a musical instrument playing application for reproducing the sound of a musical instrument exists among the tens to hundreds of thousands of applications provided to the electronic devices. Such a musical instrument playing application typically provides the user with a User Interface (UI), namely, a musical instrument UI, which resembles an actual appearance of the musical instrument, and thereby enables the user to play the musical instrument, according to an action corresponding to a method for playing the actual musical instrument.

However, the above-described musical instrument playing application may have difficulty implementing a musical instrument in the electronic device by using only the musical instrument UI. For example, when the user plays the actual musical instrument, the user must use various body parts, such as the user's mouth and feet as well as the user's hands. However, the musical instrument UI may be implemented to be capable of being controlled by only the user's hands. Accordingly, the user may have difficulty playing the musical instrument UI by using various body parts as if the user played the actual musical instrument. In this regard, the user has difficulty playing the musical instrument UI by using a playing technique identical to the method for playing the actual musical instrument.

Also, because the size of a display included in the electronic device is limited, it is difficult to implement a UI in the display, which resembles various musical instruments.

The above information is presented as background information only to assist with an understanding of the present disclosure. No determination has been made, and no assertion is made, as to whether any of the above might be applicable as prior art with regard to the present disclosure.

SUMMARY

Accordingly, an aspect of the present disclosure is to provide a method and an apparatus for outputting a sound, which enable the performance of a musical instrument to be input by using a voice.

Another aspect of the present disclosure is to provide a method and an apparatus capable of outputting a sound in such a manner as to reflect various components (e.g., a vocal length, a vocal pitch, a vocal volume, etc.) included in an input voice of a user.

In accordance with an aspect of the present disclosure, a method for outputting a sound is provided. The method includes receiving an original sound as an input, identifying an output sound object corresponding to the original sound, and generating and outputting an output sound in such a manner as to reflect musical characteristics of the original sound in the output sound object.

The identifying of the output sound object may include identifying voices in a unit of syllable of the original sound, identifying an acoustic characteristic of the original sound, and identifying an output sound object corresponding to an acoustic characteristic of the original sound.

Also, the identifying of the output sound object may include identifying a vocal length and a vocal pitch of the original sound, and outputting a sound source of the identified output sound object in such a manner as to reflect the identified musical characteristics of the original sound.

In accordance with another aspect of the present disclosure, an electronic device is provided. The electronic device includes an input/output module configured to receive an original sound as an input, a controller configured to identify the input of the original sound, to identify an output sound object corresponding to the original sound, and to generate an output sound by reflecting musical characteristics of the original sound in the output sound object, and a multimedia module configured to reproduce the output sound.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which:

FIG. 3A is a view illustrating an example of an original sound used in a method for outputting a sound according to another embodiment of the present disclosure;

FIG. 3B is a view illustrating an example of voices in a unit of syllable of an original sound used in a method for outputting a sound according to another embodiment of the present disclosure;

FIG. 3C is a view illustrating an example of a relation between a voice in a syllable unit and an acoustic characteristic value, which is used in a method for outputting a sound, according to another embodiment of the present disclosure;

FIG. 4B is a view illustrating an example of a relation between an acoustic characteristic value and a sound of a musical instrument included in a drum, which is used in a method for outputting a sound, according to another embodiment of the present disclosure;

FIG. 4D is a view illustrating output sound objects based on acoustic characteristic values according to an embodiment of the present disclosure.

FIG. 7 is a view illustrating an example of a relation among an original sound, an acoustic characteristic value and an output sound object, which is used in a method for outputting a sound, according to another embodiment of the present disclosure.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein may be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
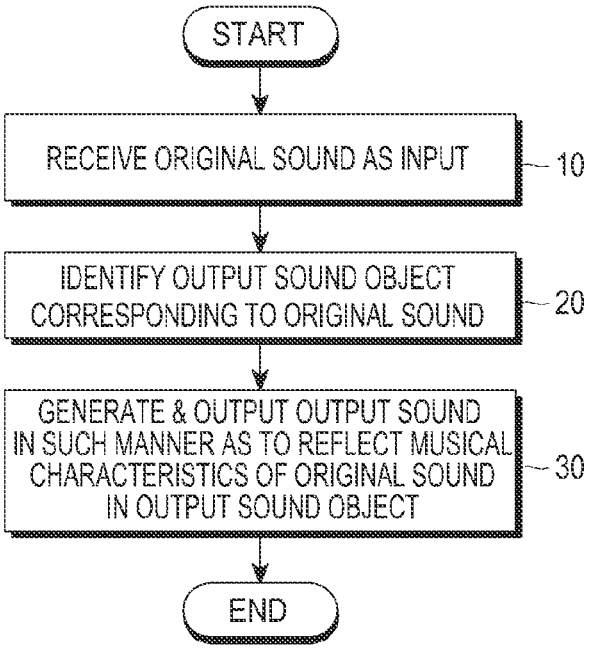
FIG. 1 is a flowchart illustrating a method for outputting a sound according to an embodiment of the present disclosure.

FIG. 1 is a flowchart illustrating a method for outputting a sound according to an embodiment of the present disclosure.

Referring to FIG. 1, the method for outputting a sound according to an embodiment of the present disclosure includes receiving an original sound as input at operation 10.

Operation 10 may include receiving an original sound as input directly from a user. For example, operation 10 may include receiving a voice of the user as input or recording the voice of the user, through a microphone included in an electronic device which processes an operation of the method for outputting a sound according to an embodiment of the present disclosure. Further, examples of the original sound may include sounds obtained by expressing a beatbox, a sound of a musical instrument, a sound of an animal, sounds of nature, and the like in the voice of the user but are not limited thereto.

In addition, as another embodiment of the present disclosure, the receiving an original sound as input at operation 10 may include reading an original sound, which has been designated and has been stored in a storage unit of the electronic device which processes an operation of the method for outputting a sound according to various embodiments of the present disclosure, or receiving an original sound, which has been designated and has been stored in an external electronic device, from the external electronic device through a communication unit.

Next, the method for outputting a sound according to an embodiment of the present disclosure includes identifying an output sound object corresponding to the original sound at operation 20.

The output sound object may be designated by the user (or a designer who has designed the method for outputting a sound), and may be stored in the electronic device. For example, the output sound object may include a sound object of a musical instrument, such as a drum. Examples of the output sound object may include sound sources respectively corresponding to sounds of relevant musical instruments.

Also, the storage unit of the electronic device which processes an operation of the method for outputting a sound according to an embodiment of the present disclosure may include an output sound object (e.g., a sound source of a musical instrument).

Further, the output sound object may be stored in such a manner as to be matched to a voice and the like (i.e., a sound, etc. obtained by expressing a beatbox or a sound of a musical instrument in the voice of the user) of the user. For example, an acoustic characteristic value is detected from the voice of the user, and the output sound object may be stored in association with the detected acoustic characteristic value. In the present example, the output sound object and the acoustic characteristic value may be associated with each other by the user (or the designer who has designed the method for outputting a sound). For example, the user (or the designer who has designed the method for outputting a sound) inputs a voice (i.e., a sound, etc. obtained by expressing a beatbox or a sound of a musical instrument in the voice of the user) of the user by using a recording function installed in the electronic device. Then, the electronic device detects an acoustic characteristic value from the input voice of the user. Also, the electronic device provides a list (hereinafter referred to as an "sound object list") of multiple output sound objects (e.g., sound sources) stored in the storage unit thereof, and provides an environment (e.g., a User Interface (UI), a menu, etc.) capable of receiving an input corresponding to the selection of at least one output sound object matched to the input voice of the user, from the sound object list. By using the environment installed in the electronic device, the user (or the designer who has designed the method for outputting a sound) may match the voice (i.e., a sound, etc. obtained by expressing a beatbox or a sound of a musical instrument in the voice of the user) of the user to the output sound object, and may store the voice of the user matched to the output sound object.

For example, the electronic device provides a voice input menu (or a voice input UI) for receiving a voice of the user as input and recording the voice of the user, and records a voice which is input through the voice input menu (or the voice input UI). The voice input menu (or the voice input UI) may display information, which guides the user to perform a predetermined voice input, to the user. For example, the electronic device displays information reading "Please input Kung." on the display thereof, and records a sound which is input through the microphone thereof. Then, the electronic device detects an area of a sound having a magnitude greater than or equal to a predetermined level among the recorded sounds, recognizes the detected area of the sound as the voice of the user, and stores the recognized area. Then, the electronic device displays, on the display thereof, an output sound object list and a sound object list menu (or a sound object list UI) which provides information guiding the user to select at least one output sound object included in the output sound object list. Next, the electronic device receives an input corresponding to the selection of at least one output sound object from the output sound object list. Then, the electronic device may match the voice of the user to the at least one selected output sound object, and may store the voice of the user matched to the at least one selected output sound object. Further, in a process for storing the voice of the user, a problem may arise in that although the user utters an identical voice corresponding to identical words (e.g., Kung), the identical voice is recognized as different voices according to a change in an environment. Accordingly, in order to more accurately classify and recognize the voices of the user, the electronic device may detect an acoustic characteristic from the stored voice of the user, and may store and manage the voice of the user based on the detected acoustic characteristic. Further, in order to standardize the voice of the user and more accurately store and manage the voice of the user, the electronic device may repeatedly receive, as input, a voice of the user corresponding to characters (e.g., Kung) multiple times, may detect multiple acoustic characteristics of the voices of the user, which have been input multiple times, may standardize the multiple acoustic characteristics, and may store and manage the multiple standardized acoustic characteristics. As described above, an operation of standardizing the multiple acoustic characteristics and storing and managing the multiple standardized acoustic characteristics may be processed by receiving, as input, the voice of the user multiple times through the voice input menu (or the voice input UI).

Further, in the above-described method for outputting a sound according to an embodiment of the present disclosure, an example has been described in which the electronic device provides the sound object list stored therein, receives an input corresponding to the selection of at least one output sound object matched to the input voice of the user by the user from the sound object list, matches the voice of the user to the output sound object, and stores the voice of the user matched to the output sound object. However, various embodiments of the present disclosure are not limited thereto. It goes without saying that in another embodiment of the present disclosure, the electronic device may analyze an acoustic characteristic of a voice (i.e., a sound, etc. obtained by expressing a beatbox or a sound of a musical instrument in the voice of the user) of the user and that of a sound source, may match the voice of the user to the output sound object, both of which have an identical acoustic characteristic or similar acoustic characteristics, and may store the voice of the user matched to the output sound object.

Further, an example has been described in which the electronic device designates and stores multiple output sound objects, provides the output sound object list, and receives an input corresponding to the selection of a corresponding output sound object. However, as another embodiment of the present disclosure, the electronic device does not designate and store multiple output sound objects, but may directly record and store a corresponding output sound object by storing a voice of the user.

As described above, the electronic device stores and manages the voices of the user based on the acoustic characteristics. Accordingly, the identifying an output sound object at operation 20 identifies an acoustic characteristic value of the original sound, and identifies the designated and stored acoustic characteristic value corresponding to the identified acoustic characteristic value. Then, an output sound object (e.g., a sound of a musical instrument included in the drum, or a sound source matched to the output sound object) matched to the designated and stored acoustic characteristic value is identified.

Meanwhile, the method for outputting a sound according to an embodiment of the present disclosure includes generating and outputting an output sound at operation 30 in such a manner as to reflect musical characteristics of the original sound. For example, the generating and outputting an output sound at operation 30 may identify the musical characteristics (e.g., a vocal length, a vocal pitch, etc.) of the original sound, may generate an output sound by reflecting the identified musical characteristics (e.g., a vocal length, a vocal pitch, a vocal volume, etc.) of the original sound in the output sound object (i.e., a sound source) identified in operation 20, and may output the output sound.

For example, operation 30 may generate a Musical Instrument Digital Interface (MIDI) note including the musical characteristics (e.g., a vocal length, a vocal pitch, a vocal volume, etc.) of the original sound. Then, operation 30 may apply the MIDI note to data (e.g., WAVE file data) including the output sound object (i.e., a sound source), and thereby may generate and store an output sound in the form of modifying the data (e.g., WAVE file data) including the output sound object (i.e., a sound source).

A vocal length and a vocal pitch are described as an example of components included in the musical characteristics of the original sound. However, various embodiments of the present disclosure are not limited thereto. Accordingly, when components are capable of reflecting musical characteristics of the original sound, the components are good enough to be included in the musical characteristics of the original sound.

Figure 2:
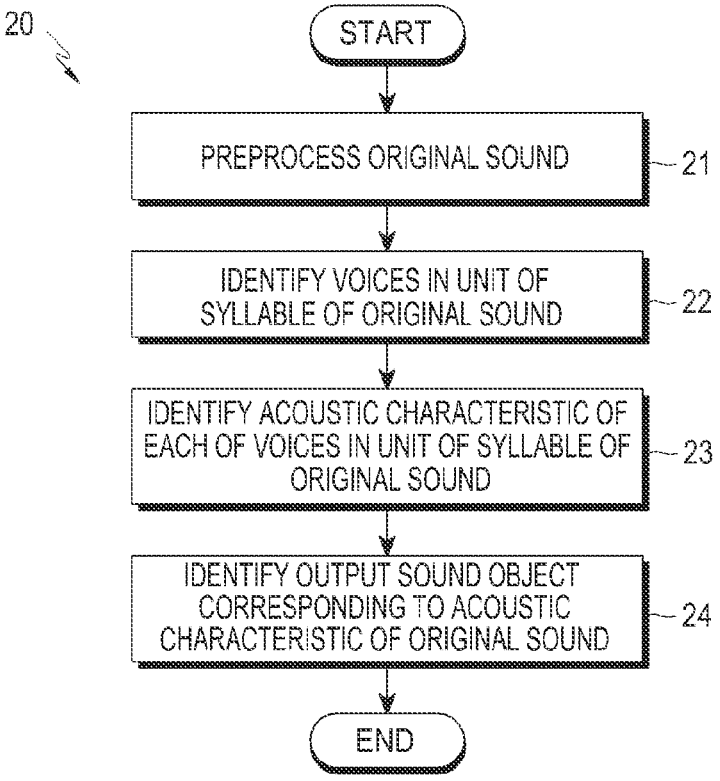
FIG. 2 is a flowchart illustrating a process for identifying an output sound object, which is included in a method for outputting a sound, according to another embodiment of the present disclosure.

FIG. 2 is a flowchart illustrating a process for identifying an output sound object, which is included in a method for outputting a sound, according to another embodiment of the present disclosure.

The method for outputting a sound according to an embodiment of the present disclosure may include operation 10 for identifying a sound and operation 30 for outputting an output sound object, which are included in the method for outputting a sound according to an embodiment of the present disclosure as described above. Particularly, the method for outputting a sound according to an embodiment of the present disclosure may include operations illustrated in FIG. 2, as another embodiment of operation 20 for identifying an output sound object. Hereinafter, operation 20' for identifying an output sound object, which is included in the method for outputting a sound according to another embodiment of the present disclosure, is distinguished from operation 20 for identifying an output sound object, by assigning a reference numeral different from that of operation 20 for identifying an output sound object, which is included in the above-described method for outputting a sound according to an embodiment of the present disclosure.

Referring to FIG. 2, operation 20' for identifying an output sound object may include operation 22 of identifying a unit of syllable of an original sound, operation 23 of identifying an acoustic characteristic of the original sound, and operation 24 of identifying an output sound object corresponding to the acoustic characteristic of the original sound.

FIG. 3A is a view illustrating an example of an original sound used in a method for outputting a sound according to another embodiment of the present disclosure. FIG. 3B is a view illustrating an example of voices in a unit of syllable of an original sound used in a method for outputting a sound according to another embodiment of the present disclosure. FIG. 3C is a view illustrating an example of a relation between a voice in a syllable unit and an acoustic characteristic value, which is used in a method for outputting a sound, according to another embodiment of the present disclosure.

In operation 22 of identifying a syllable unit of an original sound, identification is made of a syllable unit of the original sound (indicated by reference numeral 301 of FIG. 3A) identified in operation 10. Referring to FIG. 3A, the original sound is, for example, a beatbox voice including a voice, such as "Kung-Ta-Chi-Du-Ta-Kung-Kung-Dung-Cha-Du." In operation 22, a predetermined algorithm is applied to the original sound 301 (e.g., "Kung-Ta-Chi-Du-Ta-Kung-Kung-Dung-Cha-Du"), thereby, dividing a voice included in the original sound 301 in a unit of syllable. The algorithm dividing the voice included in the original sound 301 in a unit of syllable may use a voice recognition algorithm typically used in the technical field of the present disclosure. As described above, in operation 22, voices 311 to 320 in a unit of syllable may be detected from the original sound 301 including the voice, such as "Kung-Ta-Chi-Du-Ta-Kung-Kung-Dung-Cha-Du" illustrated in FIG. 3A, as illustrated in FIG. 3B.

Further, in operation 22, the original sound 301 may be divided in a unit of syllable and the voices in a unit of syllable may be provided, or the detected voices in a unit of syllable may be provided through a division information operation which enables division in a unit of syllable, without dividing the original sound 301.

Meanwhile, when a predetermined noise is included in the original sound 301 identified in operation 10 or when the volume of a voice included in the original sound 301 is excessively loud or soft, a problem may arise in that it is impossible to distinguish among voices (e.g., "Kung-Ta-Chi-Du-Ta-Kung-Kung-Dung-Cha-Du") included in the original sound 301. Accordingly, operation 20' for identifying an output sound object may further include operation 21, which includes removing the noise of the original sound 301, maintaining the volume of the voice included in the original sound 301 at a predetermined level, or the like, before performing operation 22. In operation 22 of identifying a unit of syllable of an original sound is sufficient in which the voice included in the original sound 301 is capable of being divided in a unit of syllable and an acoustic characteristic of each of voices in a unit of syllable is capable of being accurately detected. Accordingly, when the original sound 301 is good enough to be divided in a unit of syllable and to allow an acoustic characteristic of each of the voices in a unit of syllable to be accurately detected, operation 21 may not be performed. In this regard, operation 21 may be implemented to be selectively performed depending on a state of the original sound 301. For example, operation 20' for identifying an output sound object may be implemented to identify the noise of the original sound 301, and to directly proceed to operation 22 of identifying a unit of syllable of an original sound without performing operation 21, when the noise of the original sound 301 has a value less than or equal to a designated and determined threshold. Alternatively, as another embodiment of the present disclosure, when the volume of the voice of the original sound 301 is in a designated and determined range, operation 20' for identifying an output sound object may be implemented to directly proceed to operation 22 of identifying a unit of syllable of an original sound without performing operation 21. Further, operation 20' for identifying an output sound object may be implemented to directly proceed to operation 22 of identifying a unit of syllable of an original sound without performing operation 21, by comprehensively considering the noise of the original sound 301 and the volume of the voice thereof.

In operation 23 of identifying an acoustic characteristic of the original sound, detection is made of an acoustic characteristic value of each of the voices 311 to 320 in a unit of syllable, which have been identified in operation 22. For example, in order to detect an acoustic characteristic value, various schemes used in a voice processing technology may be used. Particularly, in order to detect an acoustic characteristic value, a scheme may be used for detecting various characteristic vectors of the voices 311 to 320 in a unit of syllable and detecting a characteristic parameter value (e.g., out of a range of a designated and determined threshold) which appears to be noticeable among the various characteristic vectors.

In operation 23 of identifying an acoustic characteristic of the original sound as described above, the acoustic characteristic value of each of the voices 311 to 320 in a unit of syllable may be detected as illustrated in FIG. 3C. Referring to FIG. 3C, for example, "Kung" may have a first acoustic characteristic value, "Ta" may have a second acoustic characteristic value, "Chi" may have a third acoustic characteristic value, "Du" may have a fourth acoustic characteristic value, "Dung" may have a fifth acoustic characteristic value, and "Cha" may have a sixth acoustic characteristic value.

Figure 4A:
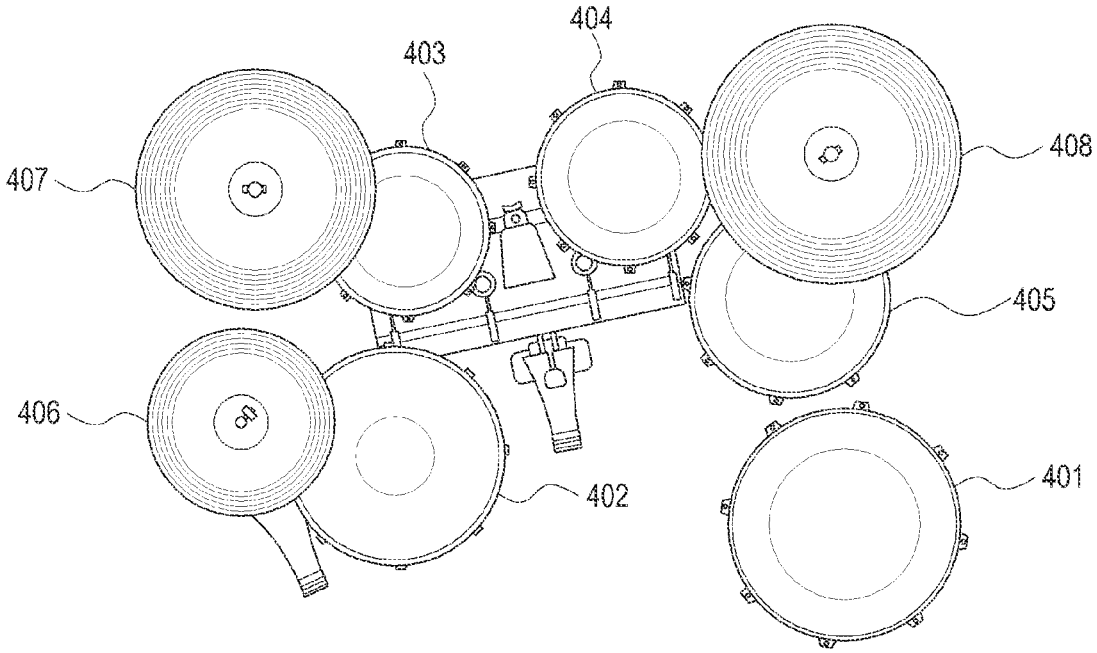
FIG. 4A is a view illustrating an example of musical instruments included in a drum used in a method for outputting a sound according to another embodiment of the present disclosure.
Figure 4C:
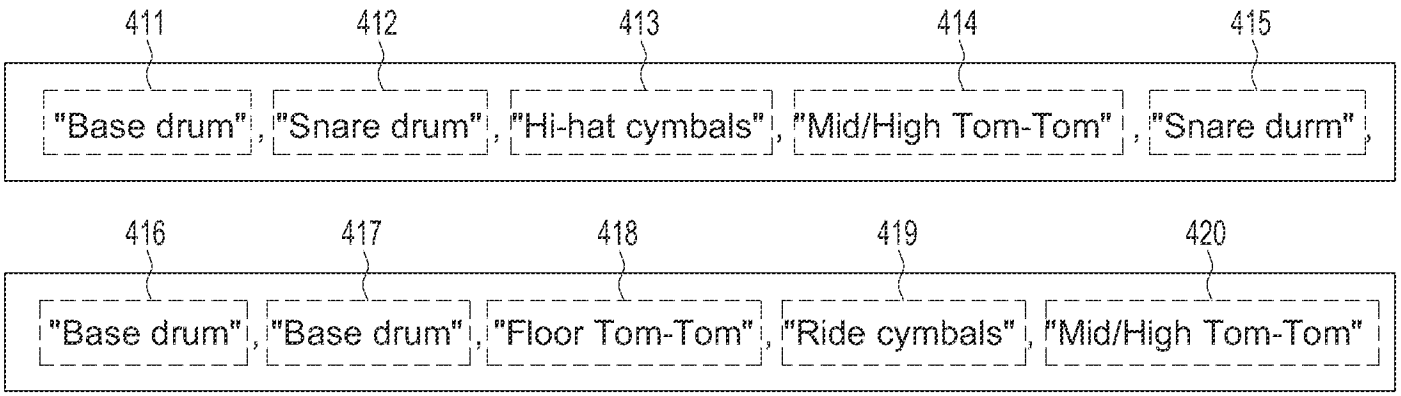
FIG. 4C is a view illustrating an example of an output sound object used in a method for outputting a sound according to another embodiment of the present disclosure.

Meanwhile, FIG. 4A is a view illustrating an example of musical instruments included in a drum used in a method for outputting a sound according to another embodiment of the present disclosure. FIG. 4B is a view illustrating an example of a relation between an acoustic characteristic value and a sound of a musical instrument included in a drum, which is used in a method for outputting a sound, according to another embodiment of the present disclosure. FIG. 4C is a view illustrating an example of an output sound object used in a method for outputting a sound according to another embodiment of the present disclosure. FIG. 4D is a view illustrating output sound objects based on acoustic characteristic values according to an embodiment of the present disclosure.

Referring to FIG. 4A, musical instruments included in the drum may include a base drum 401, a snare drum 402, a high tom-tom 403, a mid tom-tom 404, a floor tom-tom 405, hi-hat cymbals 406, a crash cymbal 407, and ride cymbals 408.

Meanwhile, the output sound object may be designated by the user (or a designer who has designed the method for outputting a sound), and may be stored in the electronic device. For example, the output sound object may include a sound of a musical instrument such as a drum, and sounds of musical instruments included in the drum may be stored as respective sounds. Accordingly, the storage unit of the electronic device, which processes an operation of the method for outputting a sound according to an embodiment of the present disclosure, may store output sound objects (i.e., sound sources) respectively including sounds of the base drum 401, the snare drum 402, the high tom-tom 403, the mid tom-tom 404, the floor tom-tom 405, the hi-hat cymbals 406, the crash cymbal 407, and the ride cymbals 408.

Further, each output sound object may be stored in such a manner as to be matched to a voice and the like (i.e., a sound, etc. obtained by expressing a beatbox or a sound of a musical instrument in the voice of the user) of the user. An acoustic characteristic value is detected from the voice of the user, and each output sound object may be stored in association with the detected acoustic characteristic value. In the present example, the output sound object and the acoustic characteristic value may be associated with each other by the user (or the designer who has designed the method for outputting a sound). For example, by using the above-described voice input menu (or voice input UI), the above-described sound object list menu (or sound object list UI), or the like, the output sound object may be matched to the acoustic characteristic value, and the output sound object matched to the acoustic characteristic value may be stored.

Referring to FIG. 4B, an output sound object (i.e., a sound source) including a sound of the base drum 401 may be stored in such a manner as to be matched to a voice corresponding to a first acoustic characteristic value. An output sound object (i.e., a sound source) including a sound of the snare drum 402 may be stored in such a manner as to be matched to a voice corresponding to a second acoustic characteristic value. An output sound object (i.e., a sound source) including a sound of the high tom-tom 403 may be stored in such a manner as to be matched to a voice corresponding to a third acoustic characteristic value. An output sound object (i.e., a sound source) including a sound of the mid tom-tom 404 may be stored in such a manner as to be matched to a voice corresponding to a fourth acoustic characteristic value. An output sound object (i.e., a sound source) including a sound of the floor tom-tom 405 may be stored in such a manner as to be matched to a voice corresponding to a fifth acoustic characteristic value. An output sound object (i.e., a sound source) including a sound of the hi-hat cymbals 406 may be stored in such a manner as to be matched to a voice corresponding to a sixth acoustic characteristic value. An output sound object (i.e., a sound source) including a sound of the crash cymbal 407 may be stored in such a manner as to be matched to a voice corresponding to a seventh acoustic characteristic value. An output sound object (i.e., a sound source) including a sound of the ride cymbals 408 may be stored in such a manner as to be matched to a voice corresponding to an eighth acoustic characteristic value.

Further, in the above-described method for outputting a sound according to various embodiments of the present disclosure, an example has been described in which the electronic device provides a list (hereinafter referred to as an "output sound object list") of multiple output sound objects (i.e., sound sources) stored therein, receives an input corresponding to the selection of at least one output sound object (i.e., sound source) matched to the input voice of the user by the user from the output sound object list, matches the voice of the user to the output sound object (i.e., sound source), and stores the voice of the user matched to the output sound object. However, various embodiments of the present disclosure are not limited thereto. In another embodiment of the present disclosure, the electronic device may analyze an acoustic characteristic of a voice (i.e., a sound, etc. obtained by expressing a beatbox or a sound of a musical instrument in the voice of the user) of the user and that of an output sound object (i.e., a sound source) (e.g., the base drum 401, the snare drum 402, the high tom-tom 403, the mid tom-tom 404, the floor tom-tom 405, the hi-hat cymbals 406, the crash cymbal 407, and the ride cymbals 408), may match the voice of the user to the output sound object (i.e., sound source), both of which have an identical acoustic characteristic or similar acoustic characteristics, and may store the voice of the user matched to the output sound object. Further, in various embodiments of the present disclosure, the method for matching the output sound object to the voice of the user is described as an example. However, various embodiments of the present disclosure are not limited thereto. Accordingly, methods capable of associating the output sound object with the voice of the user and storing the output sound object associated with the voice of the user may be used, as well as the method for matching the output sound object to the voice of the user as exemplified in various embodiments of the present disclosure.

In operation 24 of identifying an output sound object, identification is made of an output sound object (e.g., a sound of a musical instrument included in the drum) corresponding to an acoustic characteristic value of each of the voices 311 to 320 in a unit of syllable identified in operation 23. For example, a case is described in which the voice such as "Kung-Ta-Chi-Du-Ta-Kung-Kung-Dung-Cha-Du" is input. First, in operation 23, a first acoustic characteristic value corresponding to the voice "Kung" is detected. As a result, in operation 24, identification may be made of an output sound object (e.g., a sound object of the base drum 411 included in the drum) stored in such a manner as to be matched to the first acoustic characteristic value. Identification is made of a sound object of a musical instrument corresponding to each of the voices in a unit of syllable of the voice (i.e., "Kung-Ta-Chi-Du-Ta-Kung-Kung-Dung-Cha-Du") which has been input in a scheme as described above. Accordingly, as illustrated in FIG. 4C, identification may be made of output sound objects including a base drum 411, a snare drum 412, a hi-hat cymbals 413, a mid/high tom-tom 414, a snare drum 415, a base drum 416, a base drum 417, a floor tom-tom 418, a ride cymbals 419, a mid/high tom-tom 420.

In various embodiments of the present disclosure, an example has been described in which in the operation of identifying an output sound object corresponding to an original sound, identification is made of the output sound object corresponding to the acoustic characteristic value of the original sound. As another embodiment of the present disclosure, when the operation of identifying an output sound object corresponding to an original sound is performed, an output sound object may be determined by further reflecting a vocal pitch of the original sound together with the acoustic characteristic value of the original sound. For example, first, a waveform corresponding to the original sound is detected, and a sound of at least one musical instrument corresponding to the detected waveform is identified. Second, by identifying a vocal pitch of the original sound and further reflecting the identified vocal pitch of the original sound, identification may be made of a sound of a musical instrument corresponding to the vocal pitch of the original sound with respect to the sound of the at least one identified musical instrument. Specifically, first, at least one musical instrument (e.g., the high tom-tom 403, the mid tom-tom 404, and the floor tom-tom 405) included in the type of "tom-tom" is identified in view of the waveform corresponding to the original sound, the vocal pitch of the original sound is considered, and thereby it may be determined that a sound of the high tom-tom 403 is an output sound object.

Referring to FIG. 4D, an output sound object (i.e., a sound source) including a sound of a puppy may be stored in such a manner as to be matched to a voice corresponding to a first acoustic characteristic value. An output sound object (i.e., a sound source) including a sound of a cat may be stored in such a manner as to be matched to a voice corresponding to a second acoustic characteristic value. An output sound object (i.e., a sound source) including a sound of a duck may be stored in such a manner as to be matched to a voice corresponding to a third acoustic characteristic value. An output sound object (i.e., a sound source) including a sound of a chicken may be stored in such a manner as to be matched to a voice corresponding to a fourth acoustic characteristic value. An output sound object (i.e., a sound source) including a sound of a pig may be stored in such a manner as to be matched to a voice corresponding to a fifth acoustic characteristic value. An output sound object (i.e., a sound source) including a sound of calf may be stored in such a manner as to be matched to a voice corresponding to a sixth acoustic characteristic value.

Figure 5:
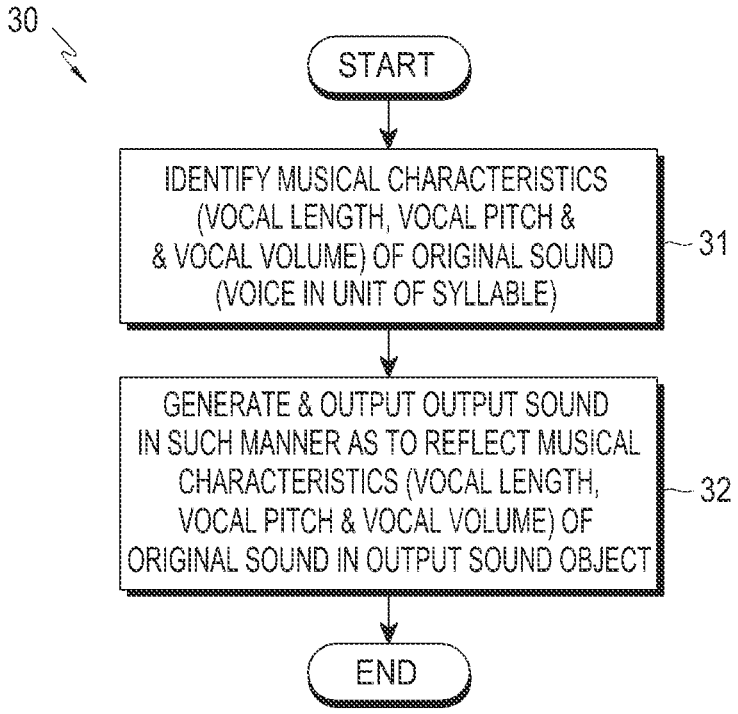
FIG. 5 is a flowchart illustrating a process for outputting an output sound, which is included in a method for outputting a sound, according to another embodiment of the present disclosure.

FIG. 5 is a flowchart illustrating a process for outputting an output sound object, which is included in a method for outputting a sound, according to another embodiment of the present disclosure.

A method for outputting a sound according to an embodiment of the present disclosure may include operation 10 for identifying a sound and operation 20 for identifying an output sound object, which are included in the above-described method for outputting a sound according to an embodiment of the present disclosure. Alternatively, the method for outputting a sound according to an embodiment of the present disclosure may include operation 10 for identifying a sound, which is included in the above-described method for outputting a sound according to an embodiment of the present disclosure, and operation 20' for identifying an output sound object, which is included in the above-described method for outputting a sound according to another embodiment of the present disclosure.

Also, the method for outputting a sound according to an embodiment of the present disclosure may include steps illustrated in FIG. 5, as another embodiment of the process 30 for outputting an output sound object. Hereinafter, a process 30' for outputting an output sound object, which is included in the method for outputting a sound according to another embodiment of the present disclosure, is distinguished from the process 30 for outputting an output sound object, by assigning a reference numeral different from that of the process 30 for outputting an output sound object, which is included in the above-described method for outputting a sound according to various embodiments of the present disclosure.

Referring to FIG. 5, the process 30' for outputting an output sound object includes operation 31 of identifying at least one of a vocal length, a vocal pitch and a vocal volume of an original sound. Also, the process 30' for outputting an output sound object outputs the output sound object (i.e., sound source) identified in operation 20 (or operation 20'), and includes operation 32 of generating and outputting an output sound in such a manner as to reflect the identified musical characteristic (e.g., a vocal length, a vocal pitch, a vocal volume, etc.) of the original sound in the output sound object.

In operation 31 of identifying a musical characteristic of the original sound, a vocal length may be identified by performing an operation of identifying a significant part of each of the voices in a unit of syllable. At this time, because there is a possibility that the voice of the user may not be input with an accurate tempo as a reference, it is desirable that a vocal length is corrected by using a reference length considering a tempo. For example, when "Kung" and "Tag," which have been input in a voice, show a ratio of 1.8:1.1 with a divided length as a reference, "Kung" and "Tag" having the ratio of 1.8:1.1 may be finally corrected so as to have a ratio of 2:1.

In operation 31 of identifying a musical characteristic of the original sound, a vocal pitch of the original sound may be identified by detecting information on a frequency distribution of the voices in a unit of syllable.

In operation 31 of identifying a musical characteristic of the original sound, a vocal volume of the original sound may be identified by detecting information on the amplitude of each of the voices in a unit of syllable.

Figure 6:
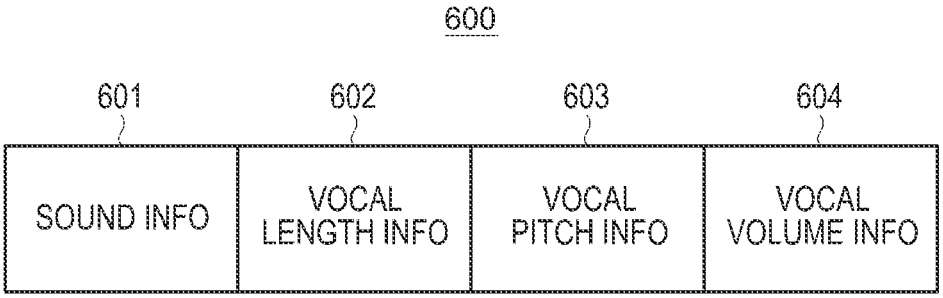
FIG. 6 is a view illustrating an example of sound data generated by a method for outputting a sound according to another embodiment of the present disclosure.

FIG. 6 is a view illustrating an example of sound data generated by a method for outputting a sound according to another embodiment of the present disclosure.

Referring to FIG. 6, in operation 32 of outputting an output sound, output sound data 600 may be generated which is obtained by including information of a musical characteristic (e.g., a vocal length, a vocal pitch, a vocal volume, etc.) of the original sound in the sound source. For example, the output sound data 600 may include at least one of sound information 601 including the output sound object (i.e., a sound source) identified in operation 20 (or operation 20'), vocal length information 602 including the vocal length identified in operation 31, vocal pitch information 603 including a vocal pitch, and vocal volume information 604 including a vocal volume.

As described above, in the method for outputting a sound according to various embodiments of the present disclosure, an example has been described in which an original sound is a voice expressing a beatbox of the user or a sound of a musical instrument, and an example has been described in which an output sound object includes a sound of a musical instrument included in a drum. However, various embodiments of the present disclosure are not limited thereto.

Various embodiments of the present disclosure are sufficient in which it is possible to generate and output a sound corresponding to an input original sound by using various characteristics of the original sound. Accordingly, examples of the original sound may include various voices as well as a voice expressing a beatbox of the user or a sound of a musical instrument. Also, examples of an output sound object may include various sounds of musical instruments and may further include various sounds (e.g., sounds of animals) existing in various environments.

Further, in the method for outputting a sound according to various embodiments of the present disclosure, an example has been described in which only an original sound is changed to an output sound and the output sound is output. However, various embodiments of the present disclosure are not limited thereto. An embodiment different from the above-described various embodiments of the present disclosure may be implemented to provide a UI (e.g., a musical instrument UI) resembling an actual appearance of a musical instrument in addition to an original sound which is input in a voice of the user, capable of receiving a user input (e.g., a touch input of a designated and determined musical instrument area included in the musical instrument UI) through the musical instrument UI, and capable of simultaneously outputting a sound of the performance of a musical instrument, which corresponds to the user input through the musical instrument UI, and the output sound.

Meanwhile, in various embodiments of the present disclosure, an example has been described in which an output sound object is a sound of a musical instrument. However, various embodiments of the present disclosure are not limited thereto.

Accordingly, examples of the output sound object may include various sounds. For example, examples of the output sound object may include a sound of an animal, sounds of nature (e.g., sounds of water, wind, falling rain, etc.), etc.

FIG. 7 is a view illustrating an example of a relation among an original sound, an acoustic characteristic value and an output sound object, which is used in a method for outputting a sound, according to another embodiment of the present disclosure.

For example, an original sound is a sound generated from a voice of the user, and may include a sound expressing a sound of an animal. Also, the output sound object may include a sound source having a sound obtained by recording the actual sound of the animal. The output sound object may be designated by the user (or a designer who has designed the method for outputting a sound), and may be stored in the electronic device.

Further, each output sound object may be designated together with the voice of the user, and each output sound object designated together with the voice of the user may be stored in the electronic device. Here, the voice of the user may be stored in such a manner as to be matched to an acoustic characteristic value by the medium of the acoustic characteristic value. For example, an acoustic characteristic value possessed by the voice of the user may be detected, and each output sound object may be stored in association with the detected acoustic characteristic value.

In the present example, the voice of the user, the acoustic characteristic value and the output sound object may be matched to one another by using the above-described voice input menu (or voice input UI), the above-described sound object list menu (or sound object list UI), or the like. The electronic device may provide a list (i.e., an output sound object list) of multiple output sound objects (i.e., sound sources) stored therein, may receive an input corresponding to the selection of at least one output sound object (i.e., sound source) matched to the input voice of the user by the user from the output sound object list, may match the voice of the user to the output sound object (i.e., sound source), and may store the voice of the user matched to the output sound object. Alternatively, as another embodiment of the present disclosure, the electronic device may receive a voice of the user as input, may analyze an acoustic characteristic of the voice of the user and that of an output sound object (i.e., a sound source), may match the voice of the user to the output sound object (i.e., sound source), both of which have an identical acoustic characteristic or similar acoustic characteristics, and may store the voice of the user matched to the output sound object.

In an embodiment as described above, when an original sound simulating a sound of an animal, for example, a sound (e.g., "bowwow") simulating a sound of a puppy is received as input, a first acoustic characteristic value of the original sound is identified, and a relevant output sound object is identified.

As another embodiment of the present disclosure, when identifying an output sound object corresponding to an original sound is performed, an output sound object may be determined by further reflecting a vocal pitch of the original sound together with an acoustic characteristic value of the original sound. For example, first, a waveform corresponding to the original sound is detected, and a sound of at least one output sound object corresponding to the detected waveform is identified. Second, by identifying a vocal pitch of the original sound and further reflecting the identified vocal pitch of the original sound, identification may be made of a sound of a musical instrument corresponding to the vocal pitch of the original sound with respect to the sound of the at least one identified output sound object.

Next, musical characteristics of the original sound are reflected in the output sound object. For example, identification is made of at least one of the musical characteristics (i.e., a vocal length, a vocal pitch, and a vocal volume) of the original sound. Then, an output sound is generated and output in such a manner as to reflect the identified musical characteristics (e.g., a vocal length, a vocal pitch, a vocal volume, etc.) of the original sound in the output sound object.

According to another embodiment of the present disclosure, in response to the input of an original sound simulating a sound of an animal by the user, an actual sound of the animal corresponding to the original sound that the user has input may be implemented as an output sound, and the output sound may be output.

Figure 8:
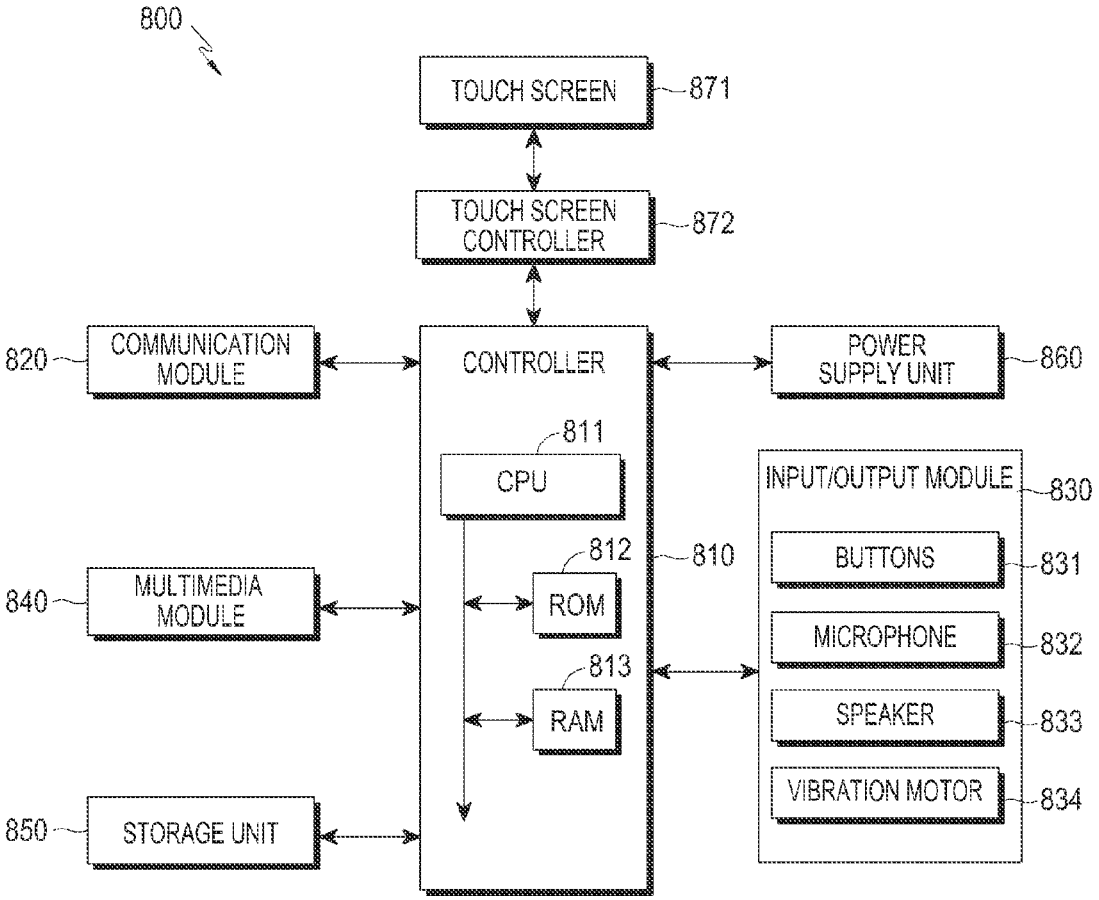
FIG. 8 is a block diagram illustrating a configuration of an electronic device, to which a method for outputting a sound is applied, according to various embodiments of the present disclosure.

FIG. 8 is a block diagram illustrating a configuration of an electronic device, to which a method for outputting a sound is applied, according to various embodiments of the present disclosure.

Referring to FIG. 8, the electronic device 800 includes a controller 810, a communication module 820, an input/output module 830, a multimedia module 840, a storage unit 850, a power supply unit 860, a touch screen 871, and a touch screen controller 872.

First, the controller 810 may include a Central Processing Unit (CPU) 811, a Read-Only Memory (ROM) 812 which stores a control program for controlling the electronic device 800, and a Random Access Memory (RAM) 813 which stores a signal or data received from the outside of the electronic device 800 or is used as a memory area for a task performed by the electronic device 800. The CPU 811, the ROM 812 and the RAM 813 may be interconnected by an internal bus. Also, the controller 810 may control the communication module 820, the input/output module 830, the multimedia module 840, the storage unit 850, the power supply unit 860, the touch screen 871, and the touch screen controller 872. Further, the controller 810 may include a single-core processor, or may include multiple processors, such as a dual-core processor, a triple-core processor, a quad-core processor, and the like. The number of cores may be variously determined according to characteristics of the electronic device 800 by those having ordinary knowledge in the technical field of the present disclosure.

Particularly, in order to perform the method for outputting a sound according to various embodiments of the present disclosure, the controller 810 may identify an original sound which has been input through the input/output module 830, may identify an output sound object corresponding to the original sound, and may generate and output an output sound in such a manner as to reflect musical characteristics of the original sound in the output sound object.

The communication module 820 may include at least one of a cellular module, a wireless Local Area Network (LAN) module and a short-range communication module but is not limited thereto.

According to the control of the controller 810, the cellular module connects the electronic device 800 to an external device through mobile communication by using at least one or more antennas (not illustrated). The cellular module transmits and receives wireless signals for voice calls, video calls, Short Message Service (SMS) messages, Multimedia Messaging Service (MMS) messages, and the like to/from a mobile phone (not illustrated), a smart phone (not illustrated), a tablet Personal Computer (PC) or another device (not illustrated), which has a telephone number input to the electronic device 800.

According to the control of the controller 810, the wireless LAN module may be connected to the Internet at a place where a wireless Access Point (AP) (not illustrated) is installed. The wireless LAN module supports a wireless LAN standard (e.g., IEEE 802.11x) of the Institute of Electrical and Electronics Engineers (IEEE). The wireless LAN module may operate a Wi-Fi Positioning System (WPS) which identifies location information of a terminal including the wireless LAN module by using position information provided by a wireless AP to which the wireless LAN module is wirelessly connected.

The short-range communication module is a module which allows the electronic device 800 to perform short-range communication wirelessly with another electronic device or devices under the control of the controller 810, and may perform communication based on a short-range communication scheme, such as Bluetooth communication, Infrared Data Association (IrDA) communication, Wi-Fi Direct communication, Near Field Communication (NFC), and the like.

Further, the communication module 820 may perform data communication with another electronic device or devise connected through a Universal Serial Bus (USB) communication cable, a serial communication cable, and the like based on a predetermined communication scheme (e.g., USB communication, serial communication, etc.).

The input/output module 830 may include at least one input/output device, such as at least one of buttons 831, a microphone 832, a speaker 833, and a vibration motor 834 but is not limited thereto.

The buttons 831 may be disposed on a front surface, a lateral surface or a rear surface of a housing of the electronic device 800, and may include at least one of a power/lock button (not illustrated), a volume button (not illustrated), a menu button, a home button, a back button a search button, and the like.

The microphone 832 may receive an original sound as input, may convert an input original sound into an electrical signal, and may provide the electrical signal to the controller 810. According to the control of the controller 810, the speaker 832 may output sounds corresponding to various signals (e.g., a wireless signal, a broadcast signal, etc.) from the cellular module, the wireless LAN module, and the short-range communication module, to the outside of the electronic device 800. The electronic device 800 may include multiple speakers. The speaker 833 or the multiple speakers may be disposed at an appropriate position or appropriate positions of the housing of the electronic device 800 for directing output sounds. Also, the speaker 833 outputs an output sound provided by the controller 810 or the multimedia module 840.

According to the control of the controller 810, the vibration motor 834 may convert an electrical signal into a mechanical vibration. The electronic device 800 may include multiple vibration motors. The vibration motor 834 or the multiple vibration motors may be mounted within the housing of the electronic device 800.

The speaker 833 and the vibration motor 834 may operate according to a setting state of a volume operating mode of the electronic device 800. Examples of the volume operating mode of the electronic device 800 may include a sound mode, a vibration mode, a sound and vibration mode, and a silent mode, and the like. The volume operating mode of the electronic device 800 may be set to one of these modes. The controller 810 may output a signal indicating an operation of the speaker 833 or the vibration motor 834 according to a function performed by the electronic device 800, based on the mode to which the volume operating mode is set.

The multimedia module 840 may include a module which reproduces a sound (particularly, the output sound) or reproduces a moving image. The multimedia module 840 may be implemented by using a separate hardware chip including a Digital-to-Analog Converter (DAC), an audio/video reproduction coder/decoder, and the like, or may be implemented within the controller 810.

According to the control of the controller 810, the storage unit 850 may store a signal or data which is input/output in response to an operation of each of the input/output module 830 and the touch screen 871. The storage unit 850 may store a control program for controlling the electronic device 800 or a control program for the controller 810, and applications. Particularly, the storage unit 850 may store a program for performing the method for outputting a sound according to various embodiments of the present disclosure or data of an application. Also, the storage unit 850 may store an original sound which is input through the microphone 832, and may store an output sound object and an output sound used in the method for outputting a sound according to various embodiments of the present disclosure. Further, the storage unit 850 may provide a UI which outputs data generated while performing the method for outputting a sound according to various embodiments of the present disclosure, or which receives a user input. Alternatively, the UI may be provided through the touch screen 871 and the touch screen controller 872 described below.

The term "storage unit" may refer to any one of or a combination of the storage unit 850, the ROM 812 and the RAM 813 within the controller 810, or a memory card (not illustrated), such as a Secure Digital (SD) card or a memory stick, which is mounted on the electronic device 800 but is not limited thereto. The storage unit may include a non-volatile memory, a volatile memory, a Hard Disk Drive (HDD), a Solid State Drive (SSD), and the like.

According to the control of the controller 810, the power supply unit 860 may supply power to one or more batteries (not illustrated) disposed in the housing of the electronic device 800. The one or more batteries supply power to the electronic device 800. Also, the power supply unit 860 may supply power provided by an external power source (not illustrated) to the electronic device 800 through a wired cable connected to the connector included in the electronic device 800. Further, the power supply unit 860 may supply power wirelessly provided by an external power source to the electronic device 800 through a wireless charging technology.

The touch screen 871 may display a UI corresponding to various services (e.g., telephone call, data transmission, broadcasting, and photography) to the user based on an Operating System (OS) of the electronic device 800. The touch screen 871 may transmit an analog signal corresponding to at least one touch, which is input to the UI, to the touch screen controller 872. The touch screen 871 may receive at least one touch as input from the user's body part (e.g., fingers, thumbs, etc.) or an input device (e.g., a stylus pen) enabling a touch. Also, the touch screen 871 may receive, as input, a continuous movement of one touch. The touch screen 871 may transmit an analog signal corresponding to a continuous movement of an input touch to the touch screen controller 872.

The touch screen 871, for example, may be implemented in a resistive type, a capacitive type, an infrared type, or an acoustic wave type.

Meanwhile, the touch screen controller 872 controls an output value of the touch screen 871 so as to enable display data provided by the controller 810 to be displayed on the touch screen 871. Then, the touch screen controller 872 converts an analog signal received from the touch screen 871 into a digital signal (e.g., X and Y coordinates), and provides the digital signal to the controller 810.

As described above, the controller 810 may process a user input by using data provided by the touch screen 871 and the touch screen controller 872. Specifically, the controller 810 may control the touch screen 871 by using the digital signal received from the touch screen controller 872. For example, the controller 810 enables a shortcut icon (not illustrated) displayed on the touch screen 871 to be selected or executed in response to a touch event or a hovering event.

Hereinabove, in an embodiment of the present disclosure, an example has been described in which a user input is received through the touch screen 871. However, various embodiments of the present disclosure are not limited thereto. Accordingly, a user input may be recognized and processed through various elements. For example, the electronic device according to an embodiment of the present disclosure may include a sensor module or a camera module, and may process a user input by using data received through the sensor module or the camera module.

For example, the sensor module may include at least one of a proximity sensor for detecting whether the user is close to the electronic device 800, an illuminance sensor for detecting the amount of light around the electronic device 800, and a Red-Green-Blue (RGB) sensor. Also, the sensor module may include a motion sensor (not illustrated) for detecting the motion of the electronic device 800 (e.g., the rotation of the electronic device 800, or acceleration or vibration applied to the electronic device 800). Further, information detected by the sensor module may be provided to the controller 810, and the controller 810 may process a user input by using the detected information.

Further, the camera module may be mounted on a front surface or a rear surface of the electronic device, and may include a camera which captures a still image or a moving image according to the control of the controller 810. A still image or a moving image captured by the camera may be provided to the controller 810. The controller 810 may process a user input by using the still image or the moving image provided by the camera.

The above-described methods according to various embodiments of the present disclosure may be implemented in the form of program instructions executable through various computer devices, and may be recorded in a computer-readable medium. The computer-readable medium may include program instructions, data files, data structures, and the like, alone or in a combination thereof. The program instructions recorded in the medium may be specially designed and configured for the present disclosure, or may be known to and usable by those skilled in the field of computer software.

Also, the methods according to various embodiments of the present disclosure may be implemented in a program instruction form and stored in the storage unit 850 of the above-described electronic device 800, and the program instruction may be temporarily stored in the RAM 813 included in the controller 810 so as to execute the methods according to the various embodiments of the present disclosure. Accordingly, the controller 810 may control hardware elements included in the electronic device 800 in response to the program commands according to the methods of the various embodiments of the present disclosure, may temporarily or continuously store data generated while executing the methods according to the various embodiments of the present disclosure in the storage unit 850, and may provide the touch screen controller 872 with UIs required for executing the methods according to the various embodiments of the present disclosure.

It will be appreciated that the various embodiments of the present disclosure may be implemented in a form of hardware, software, or a combination of hardware and software. Any such software may be stored, for example, in a volatile or non-volatile storage device such as a ROM, a memory such as a RAM, a memory chip, a memory device, or a memory IC, or a recordable optical or magnetic medium such as a CD, a DVD, a magnetic disk, or a magnetic tape, which are machine (computer) readable storage media, regardless of its ability to be erased or its ability to be re-recorded. It may be also appreciated that the memory included in the mobile terminal is one example of machine-readable devices suitable for storing a program including instructions that are executed by a processor device to thereby implement various embodiments of the present disclosure. Accordingly, the present disclosure includes a program for a code implementing the apparatus and method described in the appended claims of the specification and a machine (a computer or the like)-readable storage medium for storing the program. Further, the program may be electronically transferred by any communication signal through a wired or wireless connection, and the present disclosure appropriately includes equivalents of the program.

Also, the computer or the electronic device may receive and store a program from a device for providing a program, to which the computer or the electronic device is connected by wire or wirelessly. The device for providing a program may include: a memory configured to store a program including instructions which instruct the electronic device to perform a previously-set method for outputting a sound, information required for the method for outputting a sound, and the like; a communication unit that performs wired or wireless communication; and a controller that controls the transmission of a program. When receiving a request for providing the program from the computer or the electronic device, the device for providing a program may provide, by wire or wirelessly, the program to the computer or the electronic device. Even when the computer or the electronic device does not send the request for providing the program to the device for providing a program, for example, when the computer or the electronic device is located within a particular place, the device for providing a program may be configured to provide, by wire or wirelessly, the program to the computer or the electronic device.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A method for outputting a sound, the method comprising:

receiving an original sound as an input;

identifying an output sound object corresponding to the original sound; and generating and outputting an output sound corresponding to musical characteristics of the original sound in the output sound object, wherein the identifying of the output sound object comprises identifying voices in a unit of syllable of the original sound.

2. The method as claimed in claim 1, wherein the original sound includes a voice.

3. The method as claimed in claim 1, wherein the output sound object comprises at least one musical instrument sound object.

4. The method as claimed in claim 1, wherein the output sound object comprises at least one animal sound object.

5. The method as claimed in claim 1, wherein the original sound includes a stored original sound.

6. The method as claimed in claim 1, further comprising preprocessing the original sound.

7. The method as claimed in claim 1, wherein the identifying of the output sound object comprises:

identifying an acoustic characteristic of the original sound; and identifying a sound object designated so as to correspond to the acoustic characteristic of the original sound, as the output sound object.

8. The method as claimed in claim 7, wherein the acoustic characteristic includes a characteristic vector of the original sound.

9. The method as claimed in claim 7, wherein the identifying of the output sound object further comprises:

identifying a vocal pitch of the original sound; and identifying a sound object designated so as to correspond to the vocal pitch of the original sound, as the output sound object.

10. The method as claimed in claim 9, wherein the musical characteristics comprise a vocal volume.

11. The method as claimed in claim 1, wherein the identifying of the output sound object comprises:

identifying an acoustic characteristic of the original sound; and identifying a sound object designated so as to correspond to the acoustic characteristic of the original sound, as the output sound object.

12. The method as claimed in claim 1, wherein the musical characteristics comprise a vocal length and a vocal pitch.

13. The method as claimed in claim 1, wherein the output sound includes information indicating the output sound object and the musical characteristics.

14. An electronic device comprising:

an input/output module configured to receive an original sound as an input;

a controller configured to identify the input of the original sound, to identify an output sound object corresponding to the original sound, and to generate an output sound corresponding to musical characteristics of the original sound in the output sound object; and a multimedia module configured to reproduce the output sound, wherein the identifying of the output sound object comprises identifying voices in a unit of syllable of the original sound.

15. The electronic device as claimed in claim 14, further comprising a storage unit configured to store an output sound including information indicating the output sound object and the musical characteristics of the original sound.

16. A method for outputting a sound through an electronic device, the method comprising:

inputting a sound into the electronic device;

identifying the input sound and matching the input sound to an output sound object stored in the electronic device; and generating and outputting an output sound comprising characteristics of the input sound, wherein the identifying of the output sound object comprises identifying voices in a unit of syllable of the original sound.

17. The method as claimed in claim 16, wherein the input sound includes a voice.

18. The method as claimed in claim 16, wherein the output sound object comprises at least one musical instrument sound object.

19. The method as claimed in claim 16, wherein the output sound object comprises at least one animal sound object.

* * * * *